US005120287A

United States Patent [19]

Brown et al.

[11] Patent Number: 5,120,287

[45] Date of Patent: Jun. 9, 1992

[54] INFANT WALKING AID

[76] Inventors: Linda E. Brown, 1264 Cornelius Ct., Marriottsville, Md. 21104-1312; Cindy M. Harrison, 9331 Gentle Folk, Columbia, Md. 21045

[21] Appl. No.: 686,400

[22] Filed: Apr. 17, 1991

Related U.S. Application Data

[63] Continuation-in-part of Ser. No. 528,811, May 25, 1990, abandoned.

[51] Int. Cl.[5] ..... A63B 1/00; A01K 29/00

[52] U.S. Cl. ..... 482/69; 482/43; 119/96

[58] Field of Search ..... 272/70, 70.3, 70 A; 434/255; 119/96; 482/23, 35, 36, 37, 38, 43, 51, 69

[56] References Cited

U.S. PATENT DOCUMENTS

| | | | |
|---|---|---|---|
| 1,332,461 | 3/1920 | Bowden | 434/255 |
| 3,237,939 | 3/1966 | Olivet et al. | 272/70 |
| 4,922,860 | 5/1990 | Hutchings | 272/70 |

FOREIGN PATENT DOCUMENTS

| | | | |
|---|---|---|---|
| 0904689 | 2/1954 | Fed. Rep. of Germany | 272/70 A |
| 0175573 | 2/1922 | United Kingdom | 272/70 A |

*Primary Examiner*—Stephen R. Crow

*Attorney, Agent, or Firm*—Morton J. Rosenberg; David I. Klein

[57] ABSTRACT

An infant walking aid (20) is provided for supporting an infant contained therein during a training exercise. The infant walking aid (20) is adapted to be grasped in one hand of an operator and allows the operator to maintain control. A harness mechanism (22) encloses and supports an infant. The harness mechanism (22) defines an interior envelope within which the infant is at least partially located. A first bar member (12) adapted to be grasped by an operator is secured to an upper section of the harness mechanism (22). A second bar member (13) is flexibly secured to the harness mechanism (22) and is adapted to be grasped by the infant during a training exercise for providing support. Second bar member (13) is located external to the interior envelope of the harness mechanism (22) and is displaceable with respect thereto by the infant during the training exercise. In this manner there is provided a safe and efficient support infant walking aid which can easily be handled by an adult operator and allows an optimized training of the infant.

18 Claims, 1 Drawing Sheet

INFANT WALKING AID

REFERENCE TO RELATED APPLICATIONS

This patent application is a continuation-in-part of Ser. No. 07/528,811, filed May 25, 1990, now abandoned.

BACKGROUND OF THE INVENTION

1. Field of the Invention

This invention relates to an infant walking aid for supporting an infant or child and has for one of its purposes and objectives the teaching of an infant to walk. In particular this invention pertains to an infant walking aid which allows an adult to support and train the infant through use of only one hand of the adult operator. More in particular, this invention relates to an infant walking aid which loosely captures an infant or child within an interior envelope of a harness mechanism and allows the adult operator to maintain firm control in a simple and efficient manner. Still further, this invention relates to an infant walking aid which has a further child supporting mechanism which allows the child to grasp a bar member external to the interior envelope of the harness mechanism and acquire a sense of control and balance. Still further, this invention relates to an infant walking aid which includes a first bar member attached to the harness mechanism where the first bar member is attached to the harness mechanism at an upper section and allows the operator to grasp the bar member with one hand. Still further, this invention pertains to an infant walking aid which includes downwardly suspended flexible strap members attached to a first bar member on opposing transverse ends thereof and which are joined at an apex of the intersection of the flexible strap members. Additionally, this invention relates to a walking aid which includes a waist strap member which loosely fits around the waist of the child and maintains the child within the interior envelope of the harness mechanism. Still further, this invention relates to an infant walking aid which allows the infant to grasp a displaceable bar member and provides the child with a sense of security and balance during the training exercises.

2. Prior Art

Infant walking aids are known in the art. The best prior art known to Applicant includes Great Britain Patent #2966; Great Britain Patent #175573; U.S. Pat. Nos. 1,749,999; 1,193,374; 3,237,939; 2,956,616; 4,922,860; 3,730,587; 1,332,461; and, 3,529,819.

Some prior art walking aids do provide for a first bar member which may be grasped by an adult for manipulation and support purposes during a training exercise. Great Britain Patents #2966 and #175573 provide for a singular bar to be grasped by an adult operator and attached to a waist strap device fitted around the child. However, the walking aid shown in systems analogous to this referenced prior art does not provide for support of the child in the crotch area and relies on a waist strap which may cause injury to the infant or child. Additionally, such prior art does not provide for an additional external support which may be grasped by the child to gain a sense of control and balance.

Other prior art walking aids such as those shown in U.S. Pat. No. 1,749,999 provide a vest-like constraint for the child however, it is necessary that the user or adult operator use two hands to maintain support and control as well as manipulation. Such prior art systems have vertically extending strap members from the vest portion of the mechanism where the strap members are held in the hands of the adult operator.

Other prior art systems such as that shown in U.S. Pat. Nos. 1,193,374 and 3,237,939 all allow for the adult operator to maintain support with one hand however, these walking aid systems only provide for the waist support and do not provide for an interior envelope within which the child is constrained through a loosely fitting waist strap and a crotch support system. Additionally, as in all cases in the prior art, there is no flexibly displaceable support which the child may grasp to obtain a sense of control.

In other prior art systems such as those shown in U.S. Pat. No. 4,922,860, there is provided a crotch support for the infant or child. However, in such prior art systems, the harness mechanism having a crotch support extends through strap members which must be grasped on two ends and thus does not permit the adult operator to manipulate and control the mechanism with a one hand operation. Additionally, such prior art does not provide for a mechanism whereby the child may grasp a bar member external to the interior envelope of the harness mechanism and obtain a sense of control and balance by movement or displacement of the bar member.

Other prior art systems such as that shown in U.S. Pat. No. 3,730,587 provide for an upper bar member attached by rope members to a harness-like member having some type of crotch support. However, such prior art does not allow the child to displaceably move a bar member external to the interior envelope of the harness mechanism to aid in the control and optimize the learning process.

Other prior art systems such as that shown in U.S. Pat. No. 1,332,461 provide for baby walkers where the child may grasp a rung of a ladder-like element however, such does not provide for a displaceable member as in the subject invention concept to optimize the learning process. Additionally, such prior art systems do not contain the remaining elements of the subject invention concept.

SUMMARY OF THE INVENTION

There is provided an infant walking aid for supporting an infant. The infant walking aid includes a harness mechanism for enclosing and supporting the infant therein. The harness mechanism defines an interior envelope within which the infant is at least partially located and the harness mechanism has an extended length in a vertical direction. A first bar member is secured to an upper section of the harness mechanism with the first bar member being adapted to be grasped by an operator. A second bar member flexibly secured to the harness mechanism is adapted to be grasped by the infant for providing support. The second bar member is located external the interior envelope of the harness mechanism and is displaceable with respect thereto.

DESCRIPTION OF THE PREFERRED EMBODIMENTS

Figure 3:
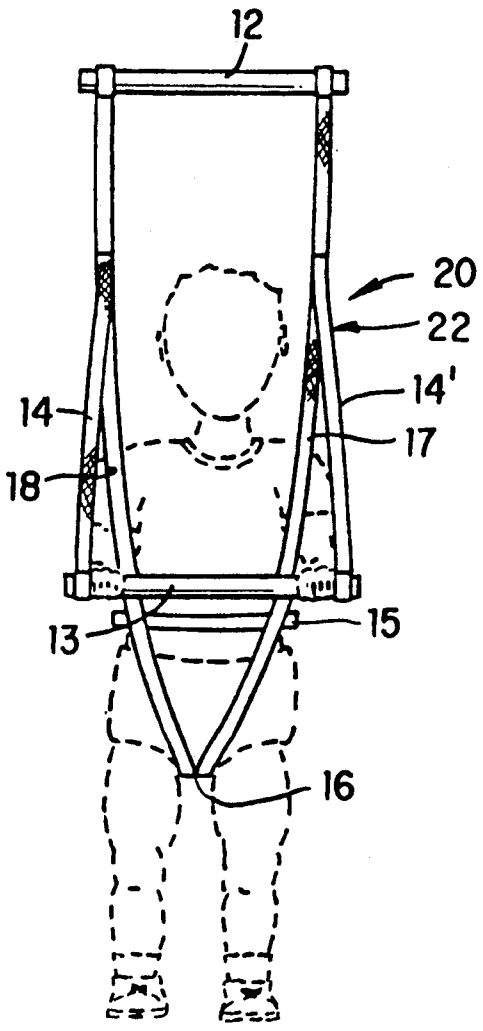
Figure 2:
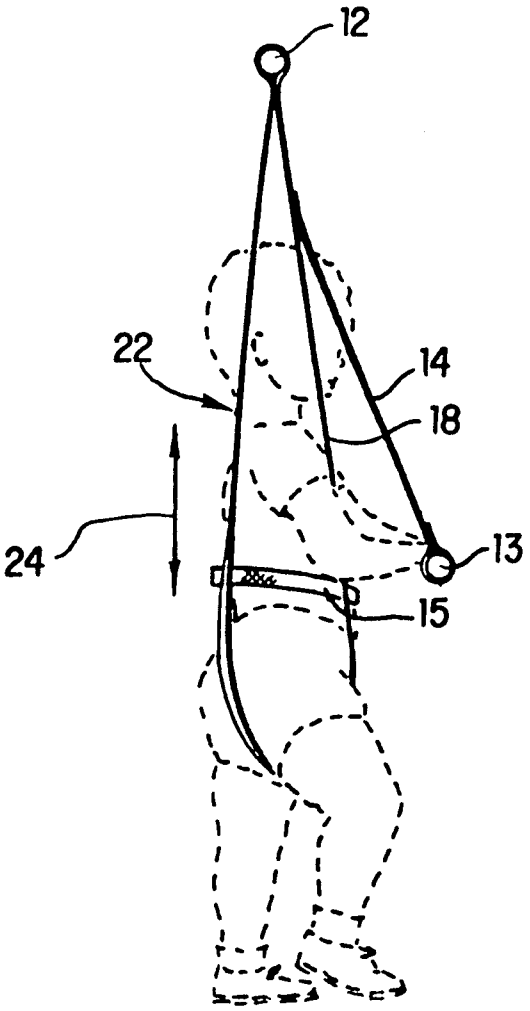
FIG. 2 is an elevational view of the infant walking aid showing the infant contained within the infant walking aid in phantom line drawing; and, FIG. 3 is a front view of the infant walking aid with the infant contained therein shown in phantom line drawing.
Figure 1:
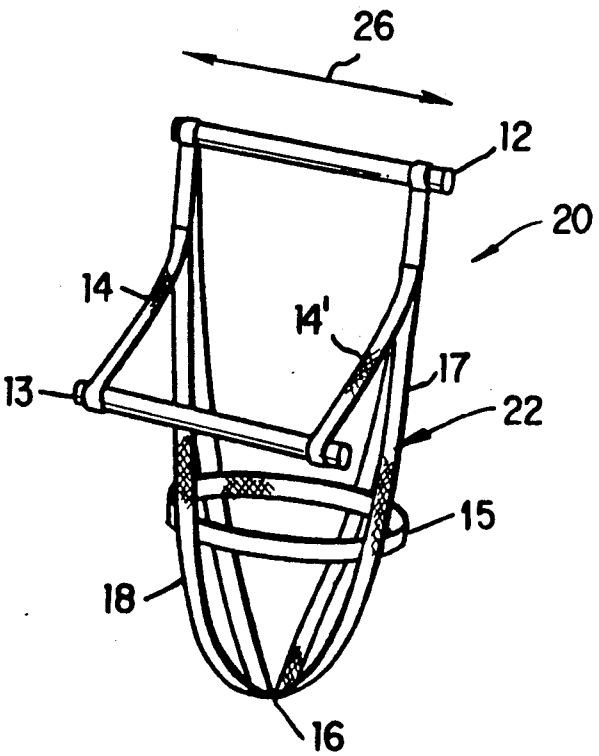
FIG. 1 is a perspective view of the infant walking aid of the subject invention concept.

Referring now to FIGS. 1-3, there is shown infant walking aid 20 for permitting an operator to assist an infant in walking and exercising while allowing an adult operator to manipulate and guide the infant with one hand. Infant walking aid 20 provides an enclosure for the infant or child, as seen in FIGS. 2 and 3, while allowing freedom of movement during training of the infant, child or toddler to walk. Still further, infant walking aid 20 as will be seen in following paragraphs provides additional support for the infant or child wherein the infant may aid in his or her support and balance.

Infant walking aid 20 includes harness mechanism 22 for enclosing and supporting the infant therein. Harness mechanism 22 as is clearly seen in FIG. 1 defines an interior envelope within which the infant as seen in FIGS. 2 and 3 is at least partially located. Harness mechanism 22 extends in vertical direction 24 and provides an open framework for maintaining a body portion of the infant within the interior envelope. As is seen in FIGS. 2 and 3, the infant's leg portions pass external to the interior envelope defined by strap members to be further described in following paragraphs. As is seen in FIG. 1, first bar member 12 is secured to an upper section of harness mechanism 22. First bar member 12 is adapted to be grasped by an adult operator throughout its extended length in the transverse direction when taken with respect to vertical direction 24. First bar member 12 extends in transverse direction 26 as is seen in FIGS. 1 and 3. First bar member 12 is fixedly coupled to harness mechanism 22 on opposing transversely displaced ends.

Harness mechanism 22 includes a pair of flexible strap members 17 and 18 which are secured to first bar member 12. As can be seen in FIGS. 1 and 3, flexible strap members 17 and 18 extend in vertical direction 24 and are joined each to the other at apex section 16 of harness mechanism 22 defining a lower section of harness mechanism 22. Each of flexible strap members 17 and 18 extends continuously from one of the opposing transverse ends of first bar member 12 to the other opposing transverse end of first bar member 12.

First strap members 17 and 18 may be formed in a loop around the opposing transversely opposed ends of first bar member 12 or otherwise joined thereto in a fixed manner. Straps 17 and 18 may be stapled, or otherwise fixedly secured to first bar member 12.

Flexible strap members 17 and 18 may cross over each other or otherwise lie contiguous each to the other at apex section 16 of harness mechanism 22. Flexible strap members 17 and 18 may be secured each to the other at apex section 16 by sewing or some like technique not important to the inventive concept as herein described with the exception that flexible strap members 17 and 18 be joined each to the other.

Flexible strap members 17 and 18 may be formed of a textile composition or may be formed of a plastic composition or some like flexible composition not important to the inventive concept as herein described.

Harness mechanism 22 includes waist strap member 15 joined to flexible strap members 17 and 18 at intersecting points as is seen in FIG. 1. Waist strap member 15 is adapted to encircle a waist portion of the infant as depicted in FIGS. 2 and 3. Waist strap member 15 is formed in a continuous closed loop formation about the waist portion of the infant to maintain the infant within the interior envelope defined by flexible strap members 17 and 18. In this manner, the infant or toddler will be releasably captured within the interior envelpe defined by the flexible strap members 17 and 18. Waist strap member 15 is fixedly secured to flexible strap members 17 and 18 through sewing or some like technique to provide support for the infant contained therein.

In order to further assist the infant during a training exercise, second bar member 13 is provided and is adapted to be grasped by the infant as shownin FIGS. 2 and 3. Second bar member 13 is displaceable from the internal envelope defined by the harness mechanism 22 and extends outwardly to be displaced at the discretion of the infant.

Displacement of second bar member 13 by the infant is important in that second bar member 13 provides additional support and allows the infant to aid in his or her own training.

Initially, the infant may grasp second bar member 13 throughout the training exercise to provide support. However, as the infant becomes more adept at a walking exercise, second bar member 13 may be less used. Additionally, through the flexibility of second bar member 13 with respect to harness mechanism 22, the displacement of second bar member 13 from the interior envelope defined by harness mechanism 22 is a variable and allows the infant to adjust for the changing center of gravity during any particular walking exercise.

Second bar member 13 is flexibly secured to the upper section of harness mechanism 22 as is clearly seen in FIGS. 1 and 2. Second bar member 13 extends in transverse direction 26 similar to the direction extension of first bar member 12. Second bar member straps 14, 14' are secured to opposing transverse ends of second bar member 13 and are attached themselves on opposing ends to respective straps 18 and 17 of harness mechanism 22. Second bar member strap members 14, 14' may be sewed or otherwise fixedly joined to flexible strap members 17 and 18. Second bar member 13 thus provides a grip for the infant and provides the infant a sense of balance and security.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. An infant walking aid for supporting an infant, comprising:

(a) harness means for enclosing and supporting said infant therein, said harness means defining an interior envelope within which said infant is at least partially located, said harness means having an extended length in a vertical direction;

(b) a first bar member secured to an upper section of said harness means, said first bar member adapted to be grasped by an operator; and, (c) a second bar member flexibly secured to said harness means adapted to be grasped by said infant for providing support, said second bar member being located external said internal envelope of said harness means and is displaceable with respect thereto, said second bar member being displaceably actuated by said infant external said internal envelope for aiding in learning a sense of balance.

2. The infant walking aid as recited in claim 1 where said harness means includes an open framework for maintaining a body portion of said infant within said interior envelope and permitting said infants legs to pass external said interior envelope.

3. The infant walking aid as recited in claim 2 where said first bar member extends in a transverse direction with respect to said vertical direction.

4. The infant walking aid as recited in claim 2 where said harness means includes at least a pair of flexible strap members secured to said first bar member on opposing transverse ends thereof.

5. The infant walking aid as recited in claim 4 where said pair of flexible strap members extend in said vertical direction and are joined each to the other at an apex section of said harness means defining a lower section of said harness means.

6. The infant walking aid as recited in claim 5 where each of said pair of flexible strap members extends continuously from one of said opposing transverse ends of said first bar member to the other opposing transverse end of said first bar member.

7. The infant walking aid as recited in claim 5 where said flexible strap members are sewn each to the other at said apex section of said harness means.

8. The infant walking aid as recited in claim 5 where said flexible strap members are formed of a textile composition.

9. The infant walking aid as recited in claim 5 where said flexible strap members are formed of a plastic composition.

10. The infant walking aid as recited in claim 5 where said harness means includes a waist strap member joined to said pair of flexible strap members at a mid-section of said harness means for encircling a waist portion of said infant.

11. The infant walking aid as recited in claim 10 where said waist strap member is formed in continuous closed loop formation about said waist portion of said infant.

12. The infant walking aid as recited in claim 11 where said waist strap member is sewn to said pair of said flexible strap members at intersecting points thereof.

13. The infant walking aid as recited in claim 5 where said second bar member is flexibly secured to said upper section of said harness means.

14. The infant walking aid as recited in claim 13 where said second bar member extends in said transverse direction with respect to said vertical direction.

15. The infant walking aid as recited in claim 14 including a pair of second bar member strap members secured to opposing transverse ends of said second bar member.

16. The infant walking aid as recited in claim 15 where each of said second bar member strap members is joined respectively to one of said pair of strap members of said harness means.

17. The infant walking aid as recited in claim 16 where each of said second bar member strap members is sewn to respective harness means strap members at said upper section of said harness means.

18. The infant walking aid as recited in claim 17 where said second bar member is displaceable with respect to said harness means.

* * * * *